US006718790B2

(12) United States Patent
Moriguchi et al.

(10) Patent No.: US 6,718,790 B2
(45) Date of Patent: Apr. 13, 2004

(54) COOLING DEVICE, CONDENSER, AND AIR CONDITIONING SYSTEM

(75) Inventors: Tetsuo Moriguchi, 6-4, Tsukaguchicho 6-chome, Amagasaki-shi, Hyogo (JP); Akira Yamaoka, Itami (JP)

(73) Assignees: Tetsuo Moriguchi, Amagasaki (JP); Sanko Service Co. Ltd., Itami (JP)

( * ) Notice: Subject to any disclaimer, the term of this patent is extended or adjusted under 35 U.S.C. 154(b) by 196 days.

(21) Appl. No.: 10/102,680

(22) Filed: Mar. 22, 2002

(65) Prior Publication Data

US 2003/0033826 A1 Feb. 20, 2003

(30) Foreign Application Priority Data

| | | |
|---|---|---|
| Aug. 7, 2001 | (JP) | 2001-275771 |
| Nov. 28, 2001 | (JP) | 2001-402263 |
| Feb. 13, 2002 | (JP) | 2002-035444 |
| Feb. 13, 2002 | (JP) | 2002-035445 |

(51) Int. Cl.[7] ..... F28C 1/00; F28D 5/00
(52) U.S. Cl. ..... 62/315; 62/316; 62/305
(58) Field of Search ..... 62/305, 315, 316

(56) References Cited

U.S. PATENT DOCUMENTS

| | | | | |
|---|---|---|---|---|
| 3,874,441 A | * | 4/1975 | Duchene | 126/633 |
| 4,007,601 A | * | 2/1977 | Webbon | 62/100 |
| 5,390,729 A | * | 2/1995 | Sakurai et al. | 109/29 |
| 5,946,931 A | * | 9/1999 | Lomax et al. | 261/100 |
| 6,282,913 B1 | * | 9/2001 | Moriguchi et al. | 62/259.2 |

FOREIGN PATENT DOCUMENTS

GB 2137328 A * 3/1984

* cited by examiner

*Primary Examiner*—William C. Doerrler
*Assistant Examiner*—Filip Zec
(74) *Attorney, Agent, or Firm*—Smith Patent Office

(57) ABSTRACT

A cooling device is constructed by a water impermeable member defining a water passage, the water impermeable member being provided with a vapor permeable member which is permeable to water vapor and impermeable to water, and has the form of a mesh and made of a material having water repellency. The cooling device has a long-life operation while preventing wear-out of the vapor permeable member. Further, optimally setting the size of an opening of the mesh member enables to securely dissipate water vapor outside of the cooling device through the vapor permeable member while efficiently suppressing water leak.

15 Claims, 7 Drawing Sheets

COOLING DEVICE, CONDENSER, AND AIR CONDITIONING SYSTEM

BACKGROUND OF THE INVENTION

1. Field of the Invention

This invention relates to a cooling device used in general industrial fields for cooling an object by water vaporization, a condenser and an air conditioning system using such cooling device.

2. Description of the Related Art

There has been proposed a water evaporative cooling device as disclosed in Japanese Unexamined Patent Publication No. 2001-244397. The cooling device disclosed in this publication includes a sheet-like vapor permeable member that is impermeable to water and permeable to water vapor, a supply channel for allowing water to pass by utilizing a capillary phenomenon, and an impermeable member in the form of a plate or a sheet made of a material impermeable to any fluid and having heat conductivity. The impermeable member is arranged on the side of an object to be cooled as opposed to the vapor permeable member with the water passage defined therebetween. The cooling device is constructed in such a manner that water supplied to the water passage evaporates by heat exchange with water coming from the side where the object is located and that the water vapor is discharged outside of the cooling device through the vapor permeable member.

The vapor permeable member is incorporated with a permeable membrane that has been developed and applied mostly in the fields of textile industries. Such a moisture permeable membrane is obtained by adhering a thin film formed with a multitude of micropores each having a size generally corresponding to one twenty-thousandth of water droplet or one thousand times as large as water vapor molecule onto a base cloth so as to provide the resultant permeable membrane with mechanical strength. The thus produced permeable membrane includes ① the one which utilizes a dimensional difference between gas molecule and liquid molecule, and ② the one that has acquired moisture permeability with use of such a physiochemical property that moisture is absorbed on a high-moisturized side with use of hygroscopicity inherent to a polyurethane film while water vapor is discharged on a low-moisturized side However, in the cooling device incorporated with the aforementioned moisture permeable membrane, contact of the membrane with water for an extended period wears out the membrane, which hinders long-time use of such a membrane. For instance, a polyurethane film disclosed in the publication causes hydrolysis owing to a long-time contact with water. As a result, it is highly likely that a membrane using a polyurethane film may tear due to a worn-out state of the polyurethane film in a worse case.

SUMMARY OF THE INVENTION

It is an object of the present invention to provide a cooling device, a condenser, and an air conditioning system which are free from the problems residing in the prior art.

According to an aspect of the invention, provided is a cooling device including a water passage a part of or a whole of which is defined by a vapor permeable member permeable to water vapor and impermeable to water, and has the form of a mesh and made of a material having water repellency. Such a cooling device can be provided in a condenser, and an air conditioning system.

These and other objects, features and advantages of the present invention will become more apparent upon a reading of the following detailed description and accompanying drawing.

DETAILED DESCRIPTION OF THE PREFERRED EMBODIMENTS OF THE INVENTION

Figure 1:
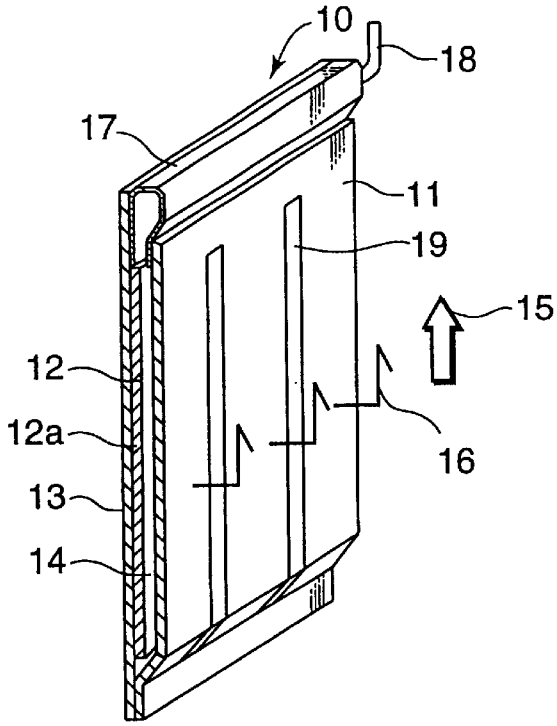
FIG. 1 is a partially cutaway perspective view of a cooling device in accordance with an embodiment of the invention.

Referring to FIG. 1, a cooling device 10 is provided with a water passage 12 which is defined by a vapor permeable member 11 and a water impermeable member 13 opposed to each other.

As will be described later, the vapor permeable member 11 is permeable to water vapor while water impermeable to water. The water impermeable member 13 is made of a material impermeable to any fluid. The water impermeable member 13 has the form of a plate or sheet. The water impermeable member 13 is disposed on the side of an object to be cooled. The material for the impermeable member 13 may be a synthetic resin including a vinyl resin for forming a thin vinyl sheet, as well as a metal such as aluminum and copper. Preferably, the material may be the one having high heat conductivity.

The water passage 12 is defined to allow water 14 to pass by a capillary phenomenon. In FIG. 1, the water passage 12 is provided with a water absorbing member 12*a* having a high water absorption power resulting from capillarity, e.g., a filter member in the form of a cloth made of a plant fiber. The opposite side surfaces of the water absorbing member 12*a* are respectively rendered into close contact with the inner surfaces of the vapor permeable member 11 and the water impermeable member 13. The vapor permeable member 11 and the water impermeable member 13 are rendered in direct close contact with each other at a region where the water absorbing member 12*a* is not provided. This arrangement minimizes the size of the cooling device 10 as a whole, which reduces the heat resistance between the parts constituting the cooling device 10.

Specifically, the vapor permeable member 11 and the impermeable member 13 are made close contact with each other by means of a fastener 19 in a state that the water absorbing member 12*a* is interposed therebetween. As the fastener 19, for example, there are: ① stitching the members 11 and 13 at a certain interval, ② applying an adhesive agent between the members 11 and 13, ③ thermally fusing the members 11 and 13, or ④ connecting the members 11 and 13 mechanically with use of a rivet or a bolt.

In the above construction, the water absorbing member 12*a* is provided with a forcible water absorption function by utilizing water absorbing action due to capillarity.

A water distributor 17 is arranged above the water passage 12 to distribute water over the water passage 12. A water feeding tube 18 is connected to the water distributor 17 to feed water from outside of the cooling device 10.

Figure 2:
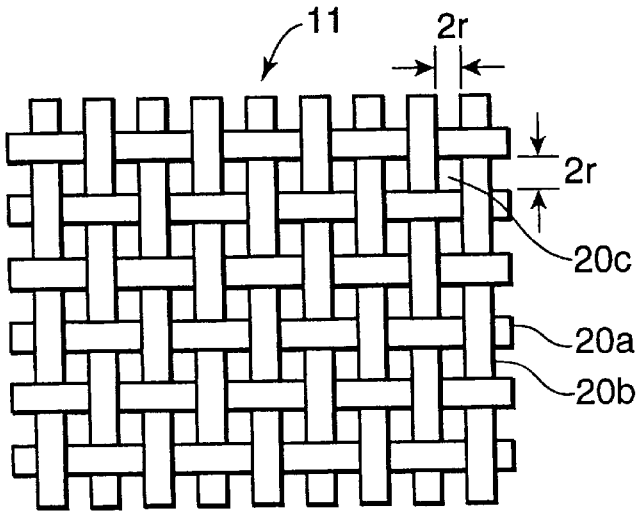
FIG. 2 is an enlarged plan view showing a construction of a vapor permeable member constituting the cooling device.

FIG. 2 is an enlarged plan view showing an example of the vapor permeable member 11. The vapor permeable member 11 shown in FIG. 2 has a mesh made of fiber yarn 20 having water repellency. Specifically, the vapor permeable member 11 is made such that plural warps 20*a* and wefts 20*b* of the fiber yarn 20 extending generally perpendicular to each other are woven to define substantially rectangular openings 20*c*.

The fiber yarn 20 having water repellency may preferably be made of teflon, polyethylene, polypropylene, etc. Alternatively, the vapor permeable member 11 may include a mesh obtained by coating a fluoroethylene resin onto stainless steel wire gauze in light of practical use. The openings 20*c* of the meshed member has such a size as to trap water 14 passing through the water passage 12 therein by water surface tension so as keep the water 14 from flowing out of the opening 20*c*.

Figure 3:
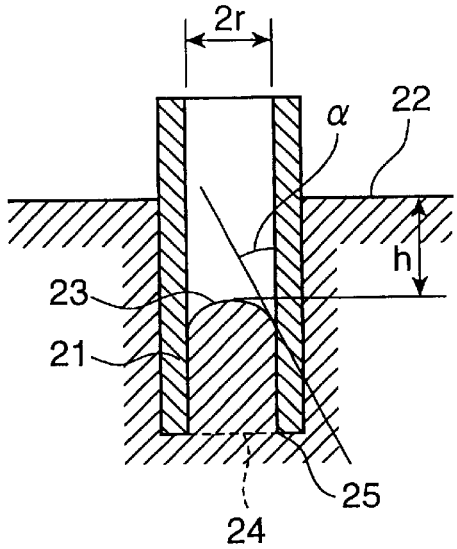
FIG. 3 is a diagram for explaining a principle of water retention by a surface tension.

FIG. 3 is a diagram showing a state that an uppermost water level in a capillary tube 21 is lowered below a reference water level 22 when the capillary tube 21 is let stand in water. A phenomenon that water moves up and down in the capillary tube 21 is generally referred to as the capillary phenomenon. In the case where a contact angle $\alpha$ defined by an inner wall of the capillary tube and a tangential line at a contact point of water with the inner wall is smaller than 90°, an uppermost plane 23 of the water in the capillary tube 21 is raised above the reference water level 22. On the other hand, in the case where the contact angle $\alpha$ is larger than 90°, as shown in FIG. 3, the uppermost plane 23 is lowered below the reference water level 22. A distance between the uppermost plane 23 which moves up and down in the capillary tube 21 due to such a capillary phenomenon and the reference water level 22 is calculated in accordance with equation (1).

$$h=(2T\cos\alpha)/(g\ \rho r) \tag{1}$$

where

T: surface tension of liquid;

g: gravitational acceleration $\rho$: density of liquid $\alpha$: contact angle, and r: diameter of capillary tube The above equation shows that water can be retained by a surface tension acting on a vicinity 25 of an orifice 24 of the capillary tube as far as a water pressure exerted to the orifice 24 of the capillary tube is equal to or less than a pressure corresponding to the distance h. Specifically, setting a dimension of the opening 20*c* of the vapor permeable member 11, namely, a length of a side 2*r* of the opening 20*c* in a case that the opening 20*c* has a square shape as shown in FIG. 2 to satisfy the following equation (2) enables to retain the water flowing through the water passage 12 by the vapor permeable member 11 in a condition that a pressure of the water 14 flowing through the water passage 12 generally equals to a pressure corresponding to the distance h.

$$r<(2T\cdot\cos\alpha)/(g\rho h) \tag{2}$$

Figure 4:
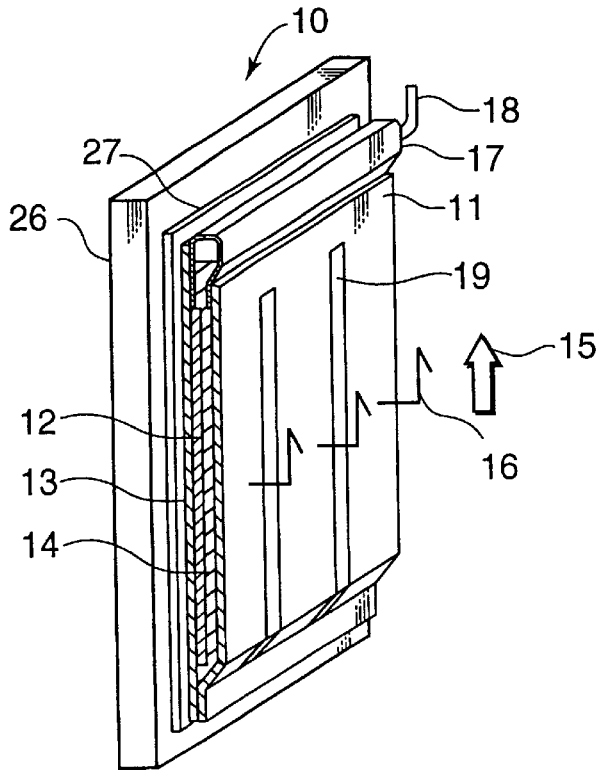
FIG. 4 is a diagram showing an arrangement to which the cooling device is applied.

Next, operations of the cooling device 10 are described. FIG. 4 is a diagram showing a state that an object 26 to be cooled is jointed with the cooling device 10 by a so-called thermo-cement 27 having high heat conductivity. The cement 27 is applied on a joint surface of the cooling device 10 and the object 26 to reduce a heat resistance at the joint portion. As shown in FIG. 4, the cooling device 10 is mounted on the object 26 in such a manner that the water impermeable member 13 is closer to the object 26 and the vapor permeable member 11 is exposed to external air.

When the object 26 is cooled, the water 14 is fed from the water feed pipe 18 to the water passage 12 via the water distributor 17 while allowing an air stream 15 to flow over the outer surface of the vapor permeable member 11. At this time, since the water absorbing member 12*a* is arranged in the water passage 12, a forcible water suction force due to a capillary phenomenon is generated in the water absorbing member 12*a*, whereby water necessary for cooling water vapor is supplied throughout the water passage 12.

Heat of the object 26 is transferred to the water passage 12 via the heat cement 27 and the water impermeable member 13, thereby heating the water 14 to vaporize while generating a water vapor stream 16. The water vapor stream 16 is permeated through the vapor permeable member 11 and is merged into the air stream 15. In this way, heat of the object 26 is dissipated outside of the cooling device 10 by water vaporization to cool the object 26.

The heat of the object 26 is transferred to the surface of the vapor permeable member 11 via the water passage 12 by heat conductivity. It should be noted, however, that the water passage 12 is required to have a thickness as small as possible to ensure a reduced heat resistance. To accomplish this object, the vapor permeable member 11 and the water impermeable member 13 are rendered to close contact with each other by the faster 19 with the water absorbing member 12*a* interposed therebetween. Further, water is distributed throughout the water passage 12 of such a narrow passage by a forcible water absorbing action due to a capillary phenomenon of the water absorbing member 12*a*. This arrangement enables to perform cooling by uniform water vaporization free while avoiding water supply suspension.

Figure 5:
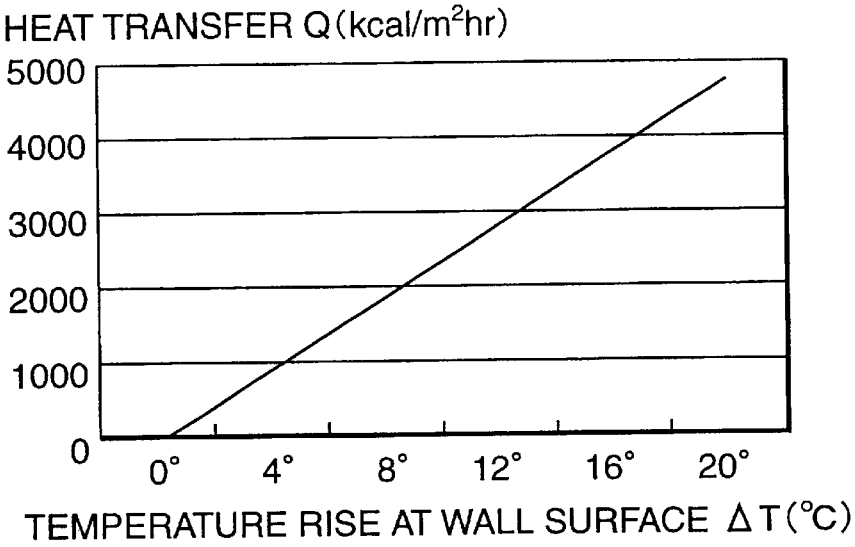
FIG. 5 is a graph showing a cooling characteristic of the cooling device.

FIG. 5 is a graph showing a relationship between a temperature rise at a wall surface of the object 26 on which the cooling device 10 is mounted and the amount of heat transferred from the object 26 to the cooling device 10 in terms of calorie per unit area per time in the case where the cooling device 10 is mounted on the object 26 to be cooled. Used was a filter-like cloth of plain weaving made of, e.g., polypropylene fiber having a thickness of 0.38 mm and permeability of 2500 $cc/cm^2\cdot min$, as the vapor permeable member 11. The graph shows that the cooling device 10 under the above conditions can perform cooling of 3000 to 5000 $kcal/m^2\cdot hr$. The cooling device 10 using the aforementioned vapor permeable member 11 shows a maximum water vapor permeability as large as 10 and several $kg/m^2\cdot hr$. The cooling device 10 can permeate water vapor several hundreds times as high as the conventional device incorporated with the conventional water moisture membrane. The used vapor permeable member 11 is resistive against water pressure as high as 100 mmAq.

As mentioned above, determining the size r2 of the opening 20*c* in such a manner that a surface tension of water retained in the opening 20*c* of the vapor permeable member 11 exceeds a water pressure of the water 14 fed through the water passage 12 enables to provide a cooling device capable of desirably permeating water vapor generated in cooling an object while suppressing water leakage from the vapor permeable member in general industrial fields.

In this embodiment, a cloth-like member obtained by weaving fiber yarn of teflon, polyethylene, polypropylene or the like into a cloth, or a mesh member obtained by coating a fluoroethylene resin onto a stainless steel wire gauze is used as the vapor permeable member 11. Alternatively, as far as the contact angle $\alpha$ of 90° or more is secured, the vapor permeable member 11 can be made of any material. With such an arrangement, even in a case where the vapor permeable member 11 is rendered contact with water for an excessively long period, the vapor permeable member 11 is usable for a long period while avoiding its deterioration.

Figure 6:
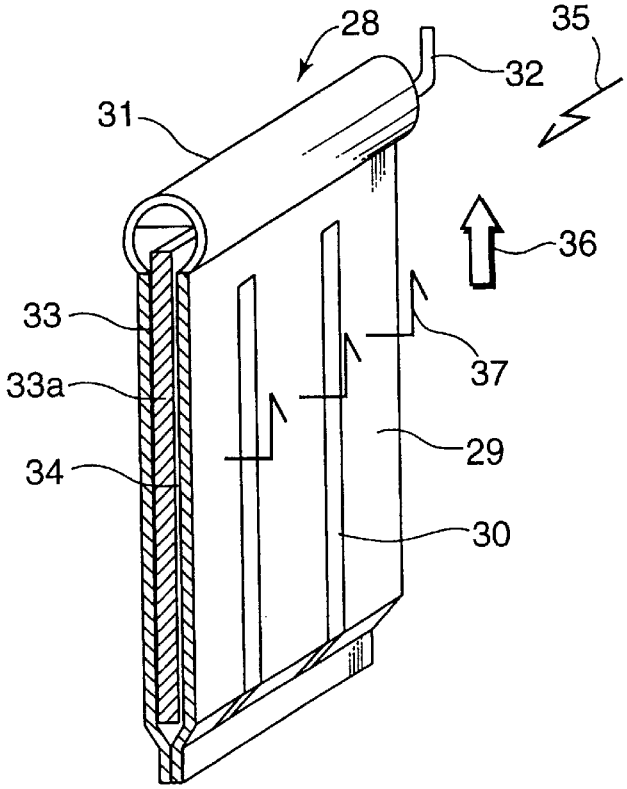
FIG. 6 is a perspective view showing an external appearance of a modified cooling device.

FIG. 6 is a partially cutaway perspective view of a modified cooling device 28. The cooling device 28 is constructed in such a manner that a pair of vapor permeable members 29 is arranged opposed to each other. Peripheral ends of the vapor permeable member pair 29 are sealed each other to render the inside of the vapor permeable member pair 29 into a watertight state. Similar to the vapor permeable member 11, each vapor permeable member 29 is a mesh permeable solely to water vapor. The vapor permeable member pair 29 is made close contact at a certain clearance by faster 30 mechanically, chemically, or thermo-fusibly. Further, the cooling device 28 is constructed in such a manner that water is introduced inside the cooling device 28 by way of a water supply port 32 provided at one end portion of water distributor 31.

A water passage 33 is defined in the vapor permeable member pair 29 to flow water therein. Specifically, a water absorbing member 33*a* having a high water absorption power resulting from capillarity, e.g., a filter member in the form of a cloth made of a plant fiber is filled in the water passage 33 defined between the vapor permeable member pair 29. Water 34 from the water distributor 31 is supplied to the water passage 33 by a water absorption power due to a capillary phenomenon of the water absorbing member 33*a*.

Next, operations of the cooling device 28 are described. In the case where an outer surface of the cooling device 28 is subjected to heat irradiation 35, an air stream 36 is generated over the outer surface of the cooling device 28. At this time, the water 34 in the water passage 33 is heated to evaporate with the result that a water vapor stream 37 is permeated through the vapor permeable members 29 and is merged into the air stream 36. The water passage 33 is replenished with water by an amount corresponding to the amount of water vapor deprived from the water absorbing member 33*a* by water vaporization in the water passage 33 by a water absorbing action due to a capillary phenomenon of the water absorbing member 33*a*.

As mentioned above, generating the air stream 36 on the outer surface of at least one of the vapor permeable member pair 29 to evaporate the water 34 in the water passage 33 and merging the water vapor stream 37 permeated through the vapor permeable member 29 into the air stream 36 for heat dissipation enables to utilize the opposite surfaces of the cooling device 28 as a surface for dissipating water vapor. This arrangement enables to provide efficient heat insulating performance against heat irradiation from exterior and to produce the cooling device 28 as a whole as small as possible while simplifying the arrangement thereof.

Further, generating the air stream 36 over the opposite surfaces of the cooling device 28 in order to promote water vaporization enables to further enhance cooling effect by heat dissipation.

Figure 7:
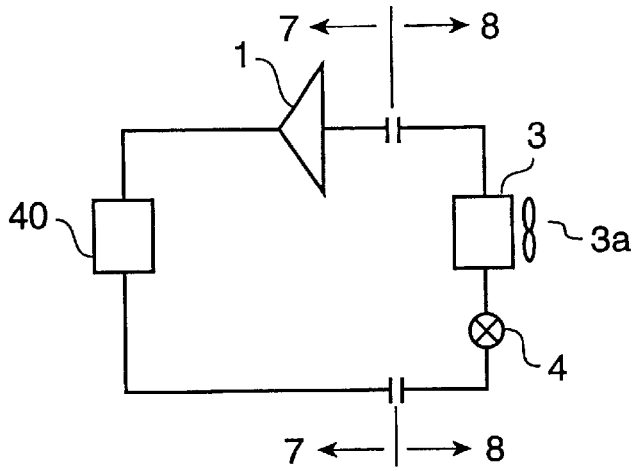
FIG. 7 is a diagram showing a configuration exemplifying an air conditioning system equipped with a condenser provided with the cooling device as a cooling module.

Next, a condenser incorporated with the aforementioned cooling device and an air conditioning system incorporated with the condenser are described. FIG. 7 is a diagram showing an air conditioning system incorporated with a condenser 40, specifically showing an exemplary configuration of an air conditioning system designed dedicatedly for cooling. The system shown in FIG. 7 includes a compressor 1, an expansion valve 4, and an evaporator 3, as well as the condenser 40.

The compressor 1 is adapted to compress a refrigerant. The condenser 40 is adapted to condense a high-temperature-high-pressure refrigerant generated in the compressor 1 to liquefy by water vaporization. The expansion valve 4 is adapted to subject the condensed refrigerant to free expansion by heat insulation. The evaporator 3 is adapted to draw air from a room (namely, object to be cooled) therein by driving a fan 3*a* so as to vaporize the refrigerant that has been subjected to free expansion by heat insulation, by heat exchange with heat in the air that has been drawn from the room. The compressor 1 and the condenser 40 constitute an external apparatus 7 installed outside of the room. The expansion valve 4 and the evaporator 3 constitute an internal apparatus 8 installed in the room to be cooled.

Figure 8:
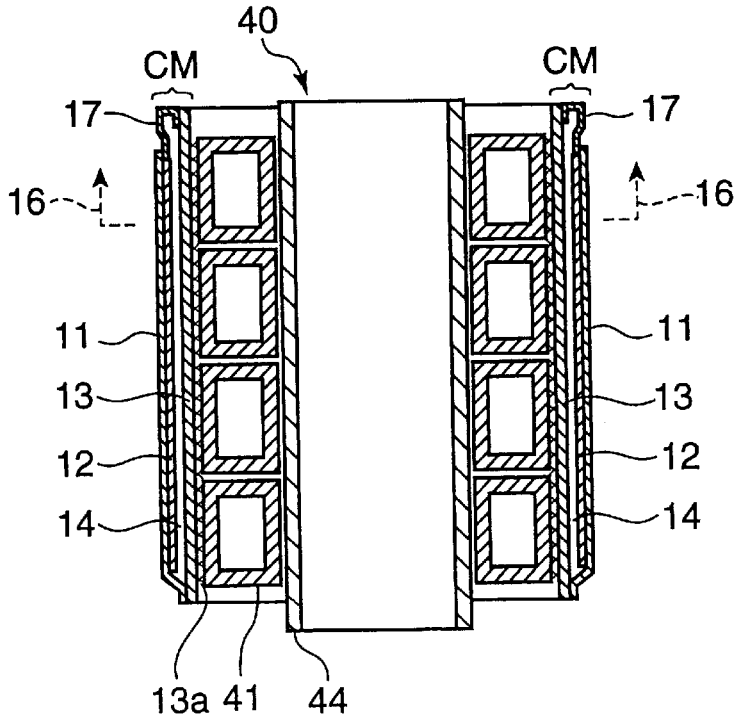
FIG. 8 is a cross sectional view showing an example of an arrangement of the condenser.

FIG. 8 is a sectional view showing an example of the condenser 40. The condenser 40 shown in FIG. 8 is constructed in such a manner that a refrigerant flow tube 41 is wound along an outer peripheral surface of a hollow support member 44.

The support member 44 may be of a circular shape, a rectangular shape, or a so-called "racetrack" shape in plan view, or other tubular shape. Alternatively, the support member 44 may have such a configuration that diameters at opposite ends thereof are differentiated according to needs. Preferably, the support member 44 may be made of a material having a sufficient mechanical strength and heat conductivity such as a metal. Alternatively, the support member 44 may be omitted according to design option.

The refrigerant flow tube 41 is adapted to flow a high-pressure refrigerant therein. The refrigerant flow tube 41 is spirally wound around and fixedly mounted on the support member 44.

In the condenser 40, furthermore, a cooling module CM incorporated with the cooling device 10 shown in FIG. 1 is arranged in close contact with the outer surface of the refrigerant flow tube 41.

Specifically, a cooling module CM is mounted on the outside of the refrigerant flow tube 41 in such a manner that the water impermeable member 13 of the cooling device 10 of the cooling module CM faces the refrigerant flow tube 41 and the vapor permeable member 11 is exposed to an external air. More specifically the entirety of the cooling module CM is cylindrically mounted on the refrigerant flow tube 41 in such a manner that the water impermeable member 13 is rendered in close contact with the outer peripheral surface of the refrigerant flow tube 41.

The expression "close contact" in the aforementioned section not only includes direct contact of the water impermeable member 13 with the refrigerant flow tube 41 but also includes indirect contact of the water impermeable member 13 with the refrigerant flow tube 41 by way of a so-called thermo cement member 13*a* shown in FIG. 8, for example. Interposing the thermo cement member 13*a* between the refrigerant flow tube 41 and the water impermeable member 13 enables to fixedly hold the cooling module CM on the refrigerant flow tube 41 while minimizing a heat resistance between the cooling module CM and the refrigerant flow tube 41.

Figure 9B:
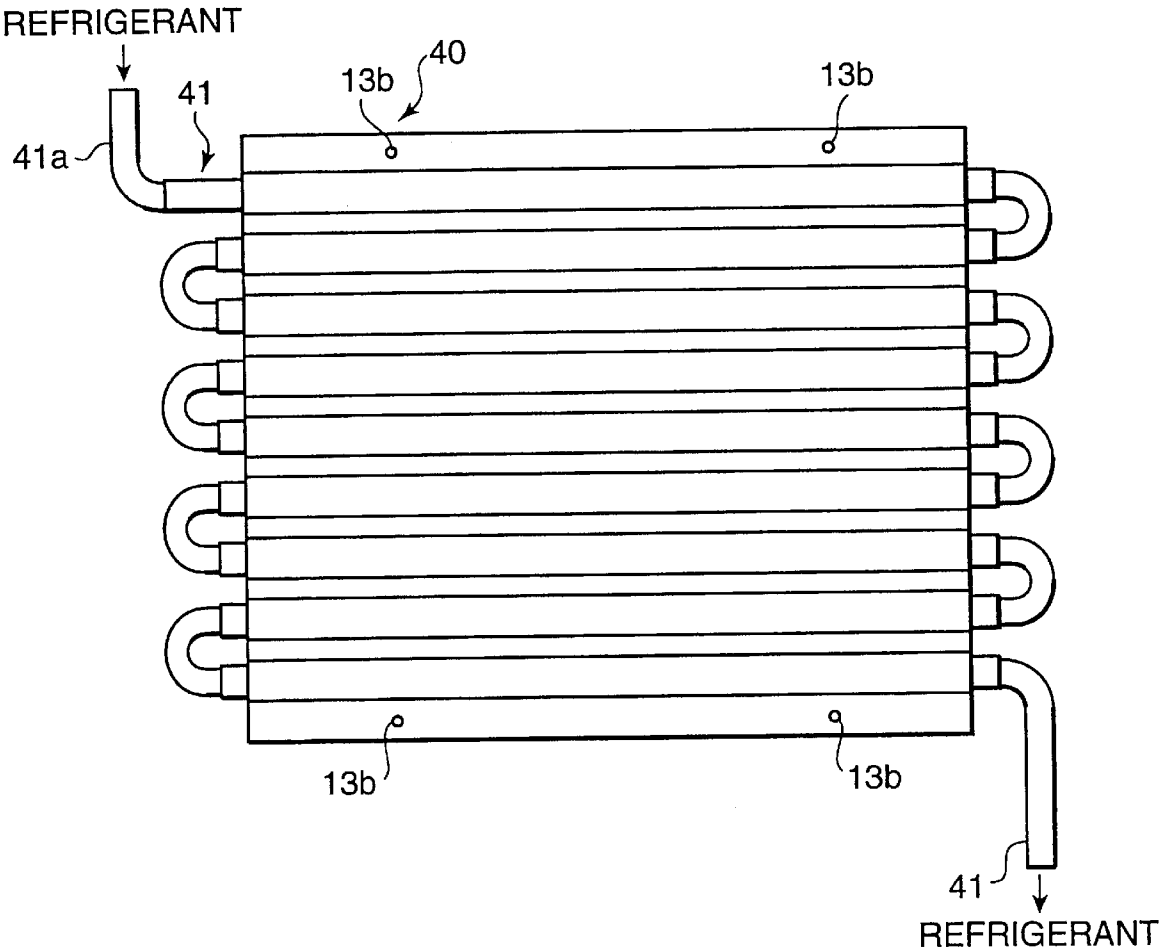
FIG. 9B is a side view of the modified condenser.
Figure 9A:
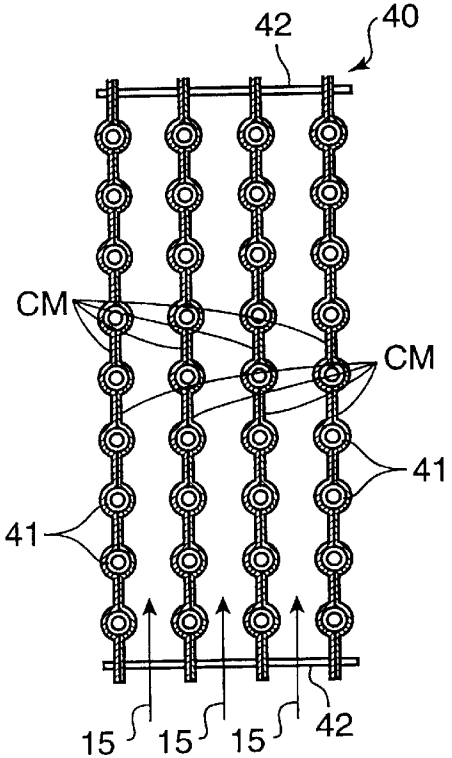
FIG. 9A is a sectional view showing a modified condenser.
Figure 10:
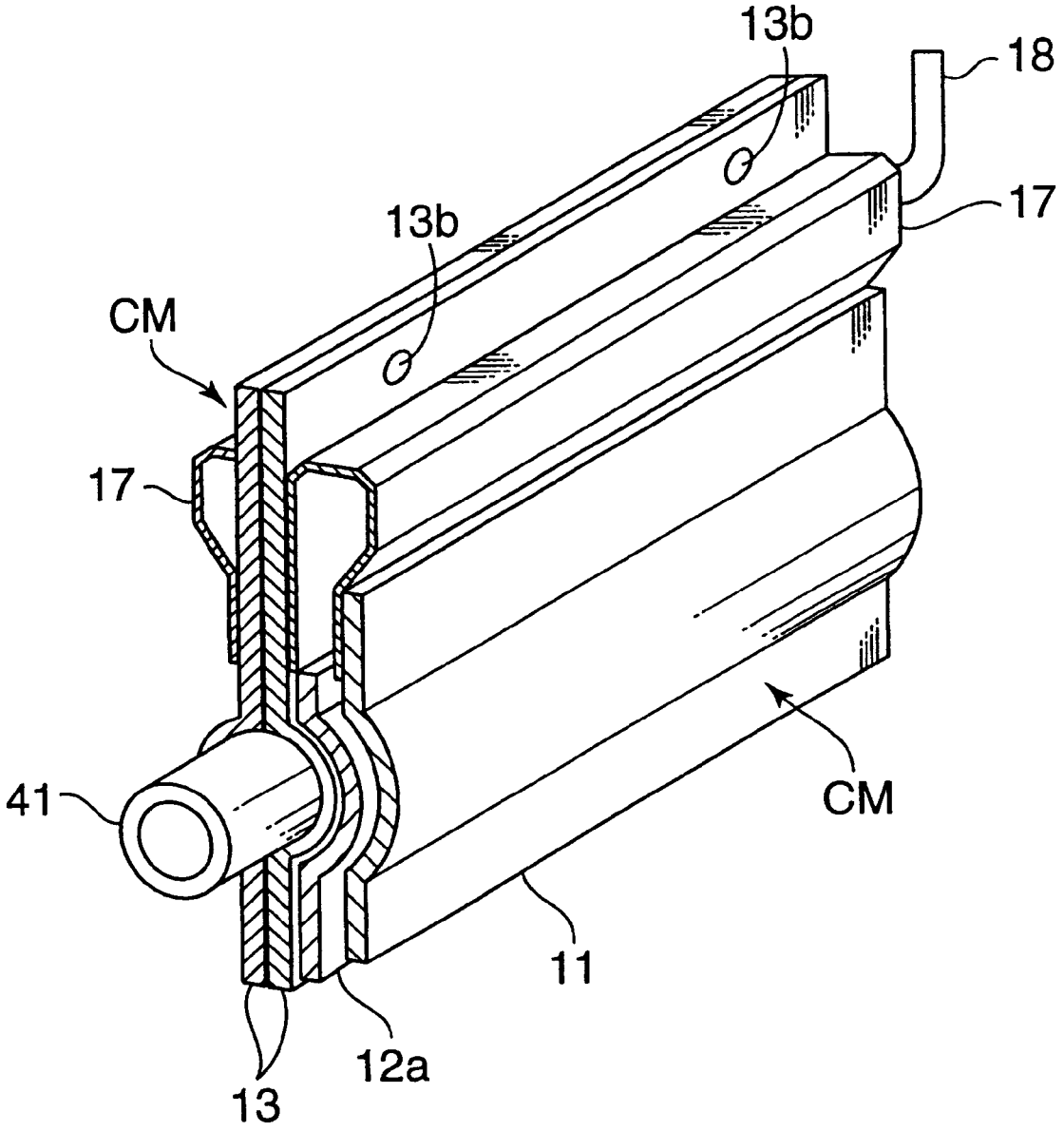
FIG. 10 is a partially cutaway perspective view showing essential parts of the modified condenser shown in FIGS. 9A and 9B.

FIGS. 9A, 9B, and 10 show a modification of the condenser 40. Similar to the embodiment, the modified condenser 40 is also incorporated with a refrigerant flow tube 41 for flowing a high-pressure refrigerant therein, and has such a construction that a cooling module CM is arranged in close contact with a surface of the refrigerant flow tube 41 for heat dissipation.

As shown in FIG. 9B, the modified condenser 40 is constructed in such a manner that an intermediate section of the refrigerant flow tube 41 is folded to plural layers overlaying vertically one over another with each layer extending horizontally. Hereinafter, the intermediate section of the refrigerant flow tube 41 is referred to as a "meandering section". An end portion of the meandering section of the refrigerant flow tube 41 is formed into a refrigerant inlet port 41*a*, and the other end portion thereof is formed into a refrigerant outlet port 41*b*. The remaining part of the meandering section of the refrigerant flow tube 41 is sandwiched between a pair of cooling modules CM.

Each cooling module CM in the modification is, composed of the cooling device 10 shown in FIG. 1. Each cooling module CM is mounted in close contact with the surface (namely, heat dissipative surface) of the meandering section of the refrigerant flow tube 41 in such a manner that an air stream generated on the surface of each cooling module CM flows generally perpendicular to the extending direction of the meandering section of the refrigerant flow tube 41 and that the both half surfaces of the meandering section of the refrigerant flow tube 41 respectively faces the corresponding cooling modules CM. More specifically, as also shown in FIG. 10, a water impermeable member 13 of each cooling module CM is rendered in close contact with the outer peripheral surface of the meandering section of the refrigerant flow tube 41.

In the case where the water impermeable member 13 is a metallic plate having a relatively high rigidity, it may be possible to construct the condenser 40 according to the following process.

1) A pair of water impermeable members 13 are prepared in such a manner that each water impermeable member 13 is formed into a shape as shown in FIG. 9A. Specifically, each water impermeable member 13 is integrally formed with a number of semi-circular portions that are adapted to fittingly cover curved surfaces of the refrigerant flow tube 41 and with flat regions each connecting the adjacent semi-circular portions vertically.

2) The opposing counterpart flat regions of the water impermeable member pair 13 are jointed each other while rendering the corresponding semi-circular portions of the water impermeable members 13 in close contact with the outer surface (heat dissipative surface) of the refrigerant flow tube 41.

3) A water absorbing member 12*a* and a vapor permeable member 11 are placed over each water impermeable member 13 after jointing in this order to construct a pair of cooling modules CM.

It should be appreciated that the expression "close contact" in the above section not only includes direct contact of the water impermeable member 13 with the refrigerant flow tube 41 but also includes indirect contact of the water impermeable member 13 with the refrigerant flow tube 41 by way of a so-called thermo cement member. Interposing the thermo cement member between the water impermeable member 13 and the refrigerant flow tube 41 enables to fixedly hold the cooling module CM on the refrigerant flow tube 41 while minimizing a heat resistance between the cooling module CM and the refrigerant flow tube 41.

The method of fabricating the inventive condenser is not limited to the foregoing embodiment.

In the embodiment, a certain number of cooling module units each constituted of a pair of cooling modules CM and a refrigerant flow tube 41 as an integral unit are arrayed horizontally at a certain interval, as shown in FIG. 9A, in such a manner that a certain space is defined between the adjacent cooling module units for generating an air stream (in FIG. 9A, an upward air stream) 15 in each space. The cooling module unit array are linked by a pair of linking rods 12 which pass through an upper and lower part thereof by way of through holes 13*b* formed in vertically opposite ends of each water impermeable member 13. The linking rod pair 12 is provided at transversely opposite ends of the cooling module unit array. As shown in FIG. 10, the water impermeable member 13 extends upwardly above the water distributor 17 from an uppermost end portion of each cooling module CM. The through holes 13*b* are formed in the extended part of each water impermeable member 13 to pass the linking rods 12, respectively.

Next, an operation of the air conditioning system having the above arrangement is described. Referring to FIG. 7, a high-temperature-high-pressure refrigerant gas ejected from the compressor 1 is drawn into the condenser 40 shown in FIG. 8, or into the refrigerant flow tube 41 of the modified condenser 40 shown in FIGS. 9A, 9B, and 10. Then, the hot gas is cooled by a cooling action of the cooling module CM in close contact with the refrigerant flow tube 41 for condensation, whereby the gas is liquefied while dissipating heat of condensation.

The heat of condensation of the refrigerant gas is fed from the refrigerant flow tube 41 to the water passage of the cooling module CM via the water impermeable member 13 of the cooling module CM to evaporate the water 14 supplied to the water passage into water vapor. The thus generated water vapor is permeated through the vapor permeable member 11 to form the water vapor stream 16, which in turn is merged with the air stream 15 flowing outside. Thus, the heat of condensation is dissipated outside.

Specifically, as mentioned above, the vapor permeable member 11 has such a property that the vapor permeable member 11 is permeable to water vapor and impermeable to water. This feature makes it possible to retain water 14 in the clearance defined by the vapor permeable member 11 and the water impermeable member 13 without water leakage therefrom and to dissipate heat of condensation outside by desirably permeating water vapor that has been generated from absorbing heat of condensation of a refrigerant. This arrangement provides the cooling module CM with a cooling action and enables to dissipate heat of condensation of a refrigerant outside by way of water vaporization.

In this way, a high-temperature-high-pressure refrigerant gas fed to the condenser 40 is subjected to condensation by the cooling action of the cooling module CM to liquefy, and the liquefied refrigerant is fed to the expansion valve 4. Upon being fed to the expansion valve 4, the liquefied refrigerant is subjected to free expansion by heat insulation to mists of refrigerant and fed to the evaporator 3. Upon being fed to the evaporator 3, mists of refrigerant are gasified while absorbing heat in the air that has been drawn from the room by driving the fan 3*a*. Simultaneously, the cooled air is supplied to the room by heat exchange to cool the room. The refrigerant that has been gasified in the evaporator 3 is fed to the compressor 1 again, and is cyclically reused as a high-temperature-high-pressure refrigerant gas after compressed in the compressor 1.

In the air conditioning system having the above arrangement, contacting the cooling module CM with the heat dissipative surface of the refrigerant flow tube 41 of the condenser 40 enables to efficiently cool the refrigerant circulating in the refrigerant flow tube 41 by utilizing latent heat for water vaporization in the cooling module CM to condense the refrigerant.

Further, the cooling module CM has such an arrangement that the sheet-like vapor permeable member 11 that is permeable to water vapor and is impermeable to water, and the plate-like or sheet-like water impermeable member 13 having heat conductivity are opposed to each other with the water passage defined therebetween. The above simplified and compact structure in which the cooling module CM of a small thickness is rendered in close contact with the heat dissipative surface of the refrigerant flow tube provides efficient condensation.

In particular, the condenser 40 shown in FIGS. 9A and 9B has an arrangement in which a pair of cooling modules CM are arranged opposed to each other in a state that the meandering section of the refrigerant flow tube 41 is sandwiched between the opposing the cooling modules CM. This arrangement enables to perform condensation by a very thin cooling module CM. Furthermore, providing an array of cooling module units each constituted of the refrigerant flow tube 41 and the cooling module pair CM as a one-piece unit and defining a certain clearance between the adjacent cooling module units to pass the air stream 15 enables to promote water vapor discharge through the vapor permeable member 11 aided by the air stream 15, which enhances condensation efficiency.

Since only a small power of the air stream 15 is required to allow the air stream 15 to promote water vapor discharge, the inventive system is substantially noise-free, compared to the conventional air cooler system employing a technique of blowing air in a refrigerant flow tube. Further, the inventive system is advantageous in that condensation efficiency is substantially not affected by an influence of an ambient room temperature.

In the air conditioning system incorporated with the condenser 40, the cooling module CM promptly absorbs heat of condensation resulting from operating the air conditioning system. Accordingly, the air conditioning system can be operated without discharging heated air outside. This arrangement provides improved habitation-related environment by suppressing a temperature rise in the external air around the air conditioning system. Furthermore, heat of condensation of a refrigerant is dissipated outside by way of water vaporization, which ensures driving of the system in an environment of a high-temperature external air.

In the embodiment, the compressor 1 and the condenser 40 constitute the external apparatus 7, and the expansion valve 4 and the evaporator 3 constitute the internal apparatus 8 to utilize the air conditioning system as a cooler for cooling the indoor. Alternatively, the condenser 40 may be used as a condenser for a cooling device or a refrigerating machine of all-purpose use.

The cross section of the refrigerant flow tube 41 may be of any shape such as an elliptical shape and a prismatic shape, as well as a rectangular shape as shown in FIG. 8 and a circular shape as shown in FIG. 9A. Furthermore, in FIG. 8, the cooling module CM is fixedly mounted in close contact with the outer surface of the refrigerant flow tube 41 which is spirally wound around the outer surface of the support member 44 by way of the thermo cement member 13*a* so as to lessen a heat resistance. Alternatively, mounting arrangement of the cooling module CM is not limited as far as the cooling module CM can be rendered in close contact with the heat dissipative surface of the refrigerant flow tube 41 with a less heat resistance, e.g., by fixedly mounting the cooling module CM on the inner surface of the support member 44 (or inner peripheral surface of the spiral refrigerant flow tube 41 in the case where the support member 44 is omitted).

FIG. 7 shows an example of a system configuration of an air conditioning system dedicatedly designed for cooling. Alternatively, as shown in FIGS. 11 and 12, an air conditioning system may be provided with a condenser 40 in parallel to or in series to a first heat exchanger 2 so as to perform heating as well as cooling.

Figure 11:
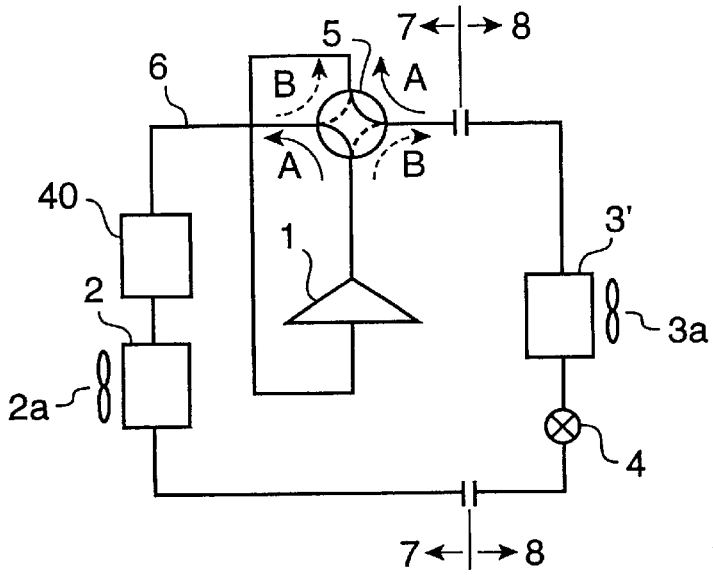
FIG. 11 is a diagram showing a configuration of a modified air conditioning system provided with the condenser.
Figure 12:
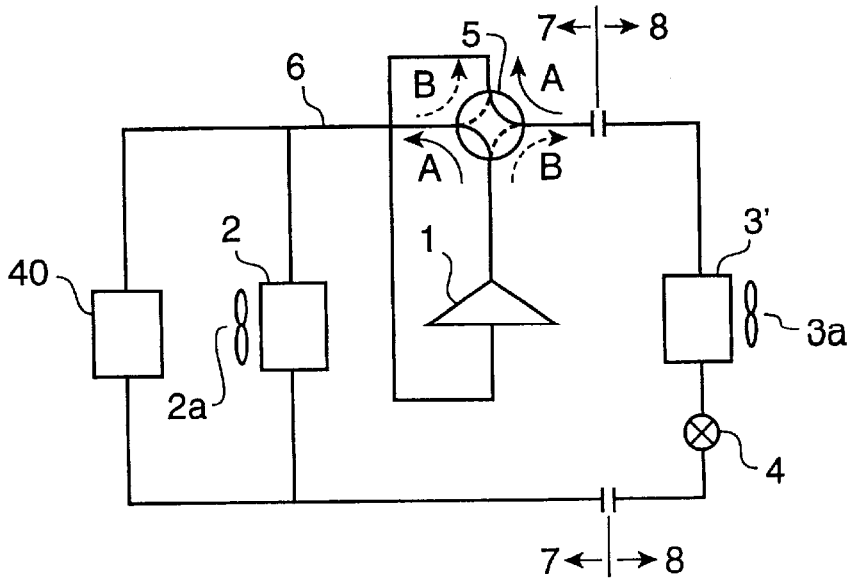
FIG. 12 is a diagram showing a configuration of another modified air conditioning system provided with the condenser.

In FIG. 11, in the case where the system is operated for cooling in summer, a high-pressure-high-temperature refrigerant gas ejected from a compressor 1 forms a stream of refrigerant in the direction of the arrow A by an action of a four-way valve 5 to feed the refrigerant to the condenser 40. Upon being fed to the condenser 40, the high-temperature-high-pressure refrigerant gas is subjected to condensation by a cooling action of a cooling module CM to liquefy. The liquefied refrigerant is fed to an expansion valve 4 by a first heat exchanger 2.

Upon being fed to the expansion valve 4, the liquefied refrigerant is subjected to free expansion by heat insulation into mists of refrigerant, which are in turn fed to a second heat exchanger 3'. Thereupon, the mists of refrigerant are gasified while absorbing heat in the air drawn from the room by driving a fan 3*a*. Simultaneously, the cooled air is supplied to the room by heat exchange to cool the room. The refrigerant gas that has been gasified by the second heat exchange 3' is drawn to the compressor 1 again, and is cyclically reused as a high-temperature-high-pressure refrigerant gas after compressed in the compressor 1.

Next, in the case where the air conditioning system is operated for heating, a high-pressure-high-temperature refrigerant gas ejected from the compressor 1 forms a stream of refrigerant in the direction of the arrow B by an action of the four-way valve 5 to feed the refrigerant to the second heat exchanger 3' serving as a condenser. Upon being fed to the second heat exchanger 3', the high-temperature-high-pressure refrigerant gas is subjected to condensation by the air drawn from the room by driving the fan 3*a*' to liquefy. The air drawn from the room is heated by absorbing heat of condensation of the refrigerant, thereby heating the room. The condensed and liquefied refrigerant is subjected to free expansion by heat insulation by the expansion valve 4 into mists of refrigerant, which are in turn fed to the first heat exchanger 2.

The first heat exchanger 2 has such a construction that a finned tube constitutes a heat exchange device so as to perform heat exchange with external air. With this arrangement, mists of refrigerant are gasified while absorbing heat in the external air drawn by driving the fan 3*a*. After gasification, the refrigerant gas is allowed to pass the refrigerant flow tube 41 constituting the condenser 40, and is fed to the compressor 1 again for compression. Thus, the refrigerant is cyclically reused as a high-temperature-high-pressure gas. In this arrangement, supplying a high-temperature gas generated in, e.g., a combustor through the refrigerant flow tube 41 of the condenser 40 enables to prevent freezing of the refrigerant flow tube 41 and its vicinity. Thus, heating of the room can be operated in a desirable manner without an operation failure.

The condenser in accordance of this invention can be designed in various manners. For instance, the refrigerant flow tube 41 may have a linear portion or a curved portion, as well as a spiral portion or a meandering portion, as long as the cooling module is mountable on the refrigerant flow tube 41 to cover the periphery of the refrigerant flow tube 41.

Alternatively, fins may be formed in the surface of the refrigerant flow tube 41 to increase a surface area thereof for heat dissipation, and the cooling module CM may be rendered in close contact with the surface of the fins.

The following experiments were conducted to verify performance of the cooling device 10.

[EXAMPLE]

Mesh members each having the properties as shown in Table was obtained by using polypropylene as a material having water repellency.

TABLE

| weaving pattern | | 3/2 twill weaving | 5/3 twill weaving | plain weaving |
|---|---|---|---|---|
| kind of yarn | Warp | multi filament | multi filament | mono filament |
| | Weft | multi filament | multi filament | mono filament |
| diameter of yarn (mm) | | about 0.1 | about 0.1 | about 0.1 |
| length of short side of opening (mm) | | about 0.1 | about 0.1 | about 0.1 |
| thickness of mesh member (mm) | | 0.49 | 0.48 | 0.38 |
| Permeability ($cm^3/cm^2 \cdot min$) | | 1200 | 600 | 2500 |

The cooling devices 10 each as shown in FIG. 1 was constructed by incorporating the aforementioned mesh members respectively as a vapor permeable member. Water at a pressure of 100 mmAq was supplied to each cooling device 10. As a result of the experiments, it was verified that all the cooling devices 10 could perform water vaporization desirably without a substantial water leakage.

In addition to the above mesh members, another mesh member was obtained by coating a fluoroethylene resin on a plain weaving stainless steel wire gauze of SUS 304 (wire diameter:0.22 mm, length of a side of opening:0.415 mm) with a coated layer having a thickness ranging from 20 to 30 $\mu$m. An experiment was performed with use of this mesh member in the same manner as the aforementioned experiments. As a result of the experiment, it was verified that the cooling device 10 incorporated with this mesh member could perform water vaporization desirably without water leakage even at a water pressure of 100 mmAq.

As described above, a cooling device includes a water passage. A part or a whole of the water passage is provided with a vapor permeable member which is permeable to water vapor and impermeable to water. The vapor permeable member is constructed in such a manner that water vapor generated by vaporization of water in the water passage dissipates outside of the cooling device therethrough. The vapor permeable member is formed into a mesh member made of a material having water repellency.

With this arrangement, the vapor permeable member is free from wearing due to a long-time contact with water since the vapor permeable member is made of a material having water repellency. Furthermore, since the mesh member is made of the water repellent material, optimally setting the size of the opening of the mesh member enables to securely discharge water vapor outside while effectively suppressing water leakage.

The vapor permeable member may not necessarily block water passage completely. As far as the vapor permeable member is usable practically, the vapor permeable member may have permeability to a negligible amount of water. According to another aspect of this invention, setting the dimension of the opening of the mesh member constituting the vapor permeable member to such a size that enables to keep water from passing through the opening against a pressure of water supplied to the water passage due to a surface tension of the water enables to securely prevent water leakage through the vapor permeable member.

It may be preferable that the cooling device is provided with a pair of water impermeable members each in the form of a plate or a sheet opposed to each other, with at least a part of the water impermeable member being the vapor permeable member and a water absorbing member is disposed in the water passage defined by the water impermeable members for enabling water to pass by a capillary phenomenon.

With this arrangement, a proper water passage is secured by utilizing a capillary phenomenon of the water absorbing member disposed in the water impermeable members, while making the thickness of the cooling device as small as possible.

In the above case, preferably, one of the water impermeable members includes the vapor permeable member in the form of a sheet, and the other of the water impermeable members includes a water impermeable member in the form of a plate or a sheet made of a material impermeable to any fluid. Alternatively, the water impermeable members each may include a vapor permeable member in the form of a sheet.

In the case where one of the water impermeable members includes the water impermeable member, arranging the parts of the cooling device such that the water impermeable member is rendered in close contact with the surface of an object to be cooled enables to efficiently absorb heat from the surface of the object to be cooled. On the other hand, in the case where both of the water impermeable members include a vapor permeable member, a sufficient surface area for discharging water vapor can be secured with a compact size of the cooling device, which efficiently discharging heat outside.

Providing the arrangement in which the water impermeable members are respectively rendered in close contact with the opposite surfaces of the water absorbing member in the arrangement as defined in claim 2 makes it possible to construct the cooling device as a whole at a thickness as small as possible. With this arrangement, desirable heat conductivity is provided while reducing a heat resistance between the water impermeable members and between the water impermeable member and the water absorbing member.

Further, provided is a condenser for condensing a refrigerant by cooling the refrigerant comprising: a refrigerant flow tube for passing a compressed refrigerant therein, the refrigerant flow tube having a surface for dissipating heat generated by condensation of the refrigerant outside; and a cooling module which is provided in close contact with the heat dissipative surface of the refrigerant flow tube to absorb the heat generated by condensation of the refrigerant by utilizing latent heat for water vaporization on the heat dissipative surface. The cooling module has a construction of the cooling device as described above and the impermeable member is arranged in close contact with the heat dissipative surface of the condenser.

With this arrangement, heat of condensation dissipated from the heat dissipative surface of the condenser is transferred to the cooling module in close contact with the heat dissipative surface, whereupon the heat of condensation is converted to latent heat for water vaporization in the cooling module. More specifically, heat of condensation transferred to the cooling module through the heat dissipative surface of the condenser is converted to latent heat for water vaporization in the cooling module. Water vapor generated by water vaporization is dissipated outside through the vapor permeable member of the cooling module. In this way, the refrigerant in the refrigerant flow tube is effectively cooled while utilizing the latent heat of water vaporization for condensation.

Since the vapor permeable member and the water impermeable member composing the cooling module are each in the form of a sheet or a plate, the cooling module can be made of a small thickness as a whole. With this arrangement, a refrigerant can be condensed by merely rendering the cooling module in close contact with the heat dissipative surface of the refrigerant flow tube. This arrangement enables to minimize the size of the condenser as a whole. Further, it is not required to cause a strong air current in the refrigerant flow tube as in the conventional art. This arrangement provides a noiseless condenser.

Preferably, the condenser may be constructed such that the refrigerant flow tube has a meandering section, and a pair of cooling modules are provided in such a manner that the meandering section is sandwiched between the cooling module pair with opposite surfaces of the meandering section in close contact therewith respectively, a direction of an air stream generated on a surface of the cooling module being generally perpendicular to an extending direction of the meandering section.

With this arrangement, the refrigerant in the refrigerant flow tube can be efficiently condensed with a thin structure of the condenser constructed such that the meandering section is sandwiched between the cooling module pair, while securing a sufficient length for the refrigerant to flow by the meandering section of the refrigerant flow tube.

The condenser may be provided with an array of cooling modules at a certain interval in such a manner that each cooling module is rendered in close contact with the corresponding meandering section and a surface of the corresponding refrigerant flow tube, and a clearance is defined between the adjacent ones of the cooling module array to pass the air stream therethrough.

With this arrangement, water vapor can be smoothly discharged through the vapor permeable member of each cooling module aided by the air stream passing in each space (namely, water vaporization on the cooling modules is promoted) while making the condenser as a whole as small as possible. Thereby, condensation efficiency can be further enhanced. Further, only a small power of the air stream is required to such an extent as to promote water vapor discharge into the space between the opposing cooling modules. This arrangement provides a substantially noiseless condenser because a large flow rate of air stream is not required.

Moreover, provided is an air conditioning system comprising: a compressor for compressing a refrigerant; a condenser including a heat dissipative surface for cooling the refrigerant compressed by the compressor to condense the refrigerant; an expansion valve for allowing the condensed refrigerant to adiabatically freely expand; and an evaporator for evaporating the expanded refrigerant while absorbing heat from an external air. The condenser has a construction of the condenser as described above.

With this arrangement, the air conditioning system can perform cooling while effectively suppressing a temperature rise around the condenser by absorbing heat of condensation dissipated from the heat dissipative surface of the condenser with use of the cooling module.

In the case where at least the condenser is incorporated in an external apparatus of the air conditioning system, this arrangement can effectively block hot air from discharging outside through the external apparatus, which contributes to prevention of deteriorating external environment This application is based on patent application Nos. 2001-275771, 2001-402263, 2002-35444, and 2002-35445 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the Claims, or equivalence of such metes and bounds are therefore intended to embraced by the claims.

What is claimed is:

1. A cooling device comprising:

a water passage having a portion being a vapor permeable member that is permeable to water vapor and impermeable to water, and has the form of a mesh and is made of a material having water repellency; and a water absorbing member being disposed in the water passage, wherein the water absorbing member is a filter member comprising a cloth including plant fiber.

2. A condenser for condensing a refrigerant, comprising:

a refrigerant flow tube for allowing a refrigerant to flow, the refrigerant flow tube having a surface for dissipating heat generated by condensation of the refrigerant outside; and a cooling module which is provided in close contact with a heat dissipative surface of the refrigerant flow tube to absorb heat generated by condensation of the refrigerant by utilizing latent heat for water vaporization on the heat dissipative surface, the cooling module having a cooling device including:

a water passage a part of or a whole of which is defined by a vapor permeable member permeable to water vapor and impermeable to water, the vapor permeable member having the form of a mesh and made of a material having water repellency.

3. The condenser according to claim 2, wherein the refrigerant flow tube has a meandering section, and the meandering section is provided between a pair of cooling modules in close contact with the cooling modules.

4. The condenser according to claim 3, wherein an array of cooling modules are arranged at a certain interval in such a manner that each cooling module is rendered in close contact with the corresponding meandering section and a surface of the corresponding refrigerant flow tube, and a clearance is defined between the adjacent ones of the cooling module array to allow air to pass therethrough.

5. An air conditioning system comprising:

a compressor for compressing a refrigerant;

a condenser including a heat dissipative surface for cooling the refrigerant compressed by the compressor to condense the refrigerant;

an expansion valve for allowing the condensed refrigerant to adiabatically expand; and an evaporator for evaporating the expanded refrigerant while absorbing heat from an external air, the condenser including:

a refrigerant flow tube for allowing a refrigerant to flow, the refrigerant flow tube having a surface for dissipating heat generated by condensation of the refrigerant outside; and a cooling module which is provided in close contact with a heat dissipative surface of the refrigerant flow tube to absorb heat generated by condensation of the refrigerant by utilizing latent heat for water vaporization on the heat dissipative surface, the cooling module having a cooling device including:

a water passage a part of or a whole of which is defined by a vapor permeable member permeable to water vapor and impermeable to water at least partly, the vapor permeable member having the form of a mesh and made of a material having water repellency.

6. The air conditioning system according to claim 5, wherein at least the condenser is incorporated in an external apparatus of the system which is installed outside.

7. A cooling device comprising:

a water passage having a portion being a vapor permeable member that is permeable to water vapor and impermeable to water, and has the form of a mesh and is made of a material having water repellency; and a water absorbing member being disposed in the water passage wherein the water absorbing member is a filter member.

8. The cooling device according to claim 7, wherein a pair of water impermeable members each having the form of a plate or a sheet are arranged opposed to each other to define the water passage, at least a part of the water impermeable member is the vapor permeable member.

9. The cooling device according to claim 7, wherein one of the water impermeable member pair includes the vapor permeable member in the form of a sheet, and the other of the water impermeable member pair includes a water impermeable member in the form of a plate or a sheet made of a material impermeable to a fluid.

10. The cooling device according to claim 7, wherein the pair of water impermeable members each includes a vapor permeable member in the form of a sheet.

11. The cooling device according to claim 7, wherein the water impermeable member pair are respectively rendered in close contact with the water absorbing member.

12. The cooling device according to claim 7, wherein the mesh has openings each having such dimensions as to trap water therein against a pressure of water in the water passage by a surface tension of water passing therethrough.

13. The cooling device according to claim 7, wherein the portion of the water passage including the vapor permeable member includes the entire water passage.

14. The cooling device according to claim 7, wherein the water absorbing member disposed in the water passage allows water to pass by a capillary phenomenon.

15. The cooling device according to claim 7, wherein said water passage includes another portion that comprises a water impermeable member, wherein the water absorbing member is disposed between the vapor permeable member and the water impermeable member.

* * * * *